US005374164A

United States Patent [19]

Schulz

[11] Patent Number: 5,374,164

[45] Date of Patent: Dec. 20, 1994

[54] FLUID JET COMPRESSOR NOZZLE ARRANGEMENT

[75] Inventor: Reiner Schulz, Aachen, Germany

[73] Assignee: Mannesmann Aktiengesellschaft, Dusseldorf, Germany

[21] Appl. No.: 64,092

[22] PCT Filed: Nov. 19, 1991

[86] PCT No.: PCT/DE91/00924

§ 371 Date: Jul. 21, 1993

§ 102(e) Date: Jul. 21, 1993

[87] PCT Pub. No.: WO92/09808

PCT Pub. Date: Jun. 11, 1992

[30] Foreign Application Priority Data

Nov. 23, 1990 [DE] Germany ..... 4037935

[51] Int. Cl.[5] ..... F04F 5/44

[52] U.S. Cl. ..... 417/196; 417/198; 239/340; 239/434

[58] Field of Search ..... 417/151, 198, 196; 239/318, 340, 369, 423, 434

[56] References Cited

U.S. PATENT DOCUMENTS

| | | | |
|---|---|---|---|
| 2,524,559 | 10/1950 | Campbell et al. | 417/198 |
| 3,012,400 | 12/1961 | Corson | 239/434.5 |
| 3,797,747 | 3/1974 | Buzzi et al. | 239/318 |
| 4,195,780 | 4/1980 | Inglis | 417/198 |
| 5,048,726 | 9/1991 | McCann et al. | 239/434 |
| 5,232,164 | 8/1993 | Resch et al. | 239/434 |

FOREIGN PATENT DOCUMENTS

| | | | |
|---|---|---|---|
| 190872 | 9/1973 | Australia | 417/198 |
| 2161288 | 7/1973 | France . | |
| 500935 | 6/1930 | Germany . | |
| 2550456A1 | 5/1976 | Germany . | |
| 3005653A1 | 8/1981 | Germany . | |
| 59-39999 | 3/1984 | Japan . | |
| 28590 | of 1912 | United Kingdom | 417/198 |

*Primary Examiner*—Richard A. Bertsch
*Assistant Examiner*—Roland G. McAndrews, Jr.
*Attorney, Agent, or Firm*—Cohen, Pontani, Liberman, Pavane

[57] ABSTRACT

The invention concerns a jet compressor for gaseous media for use in metallurgical or chemical processes having a driving nozzle which is arranged centrically in a jet head and directed toward a mixing chamber with which a diffuser is connected coaxially. In order to avoid the conventional disadvantages and provide a jet compressor which is simple in design and as compact as possible and to achieve improved efficiency and pressure ratios in comparison to jet devices of the same scale while operating in a reliable manner, it is proposed that the driving nozzle (10) be a ring jet nozzle having a conical central body (12) which narrows in diameter conically toward the mixing chamber (31) of the nozzle (30).

11 Claims, 2 Drawing Sheets

FLUID JET COMPRESSOR NOZZLE ARRANGEMENT

BACKGROUND OF THE INVENTION

The invention is directed to a jet device for concentrating or compressing gaseous media for use in metallurgical or chemical processes. The jet device having a driving nozzle which is arranged centrically in a jet head and directed toward a mixing chamber with which a pressure nozzle is connected coaxially.

Such jet compressors are used particularly for jet degasification in metallurgy plants. Steam jet pumps are essentially used for this purpose. Since the vacuum required for jet degasification cannot be achieved by a single-stage jet device, a multi-stage jet device is used.

A steam jet pump having a jet head with a driving nozzle projecting into the latter is known from "die Vakuumbehandlung des flüssigen Stahles [vacuum processing of molten steel]" by W. Coupette, R. A. Lang Verlag 1967, page 77. Also, a jet compressor which is constructed in a comparable manner, at least up to the mixing chamber, is known from DE-OS 30 05 653.

In jet compressors of the kind known from the aforementioned texts, steam is used as a driving medium. The steam is lined to the steam jet pump via the driving medium feed line, a Laval nozzle being connected to the end of the latter. The enthalpy of the steam is transformed virtually completely into kinetic energy by this nozzle. The steam enters the above-mentioned mixing chamber at ultrasonic speed, where it encounters the medium which is to be conveyed by the steam and which flows at a lesser speed. Due to the friction effect in the long Laval nozzle, a boundary layer is formed at the wall of the Laval nozzle and occupies a considerable portion of the nozzle cross section, particularly in the use regions range of application of lesser densities, corresponding to a suction pressure of approximately 1 mbar. This boundary layer represents considerable losses and slows down the turbulent mixing process at the output of the nozzle, i.e. in the region of the mixing zone. This in turn leads to a lengthening of the mixing chamber and consequently to friction losses.

A diffusion pump whose nozzle has outflow openings in the shape of annular gaps is known from DE-OS 25 50 456.

In the pump known from the above-cited text, oil vapor is used as a driving medium, its flow direction being turned by 180°. The roof arranged at the outlet of the driving-medium feed line serves as a baffle plate.

The annular-gap nozzles of the jet device known from this text are unsuitable, both in form and in capacity, for industrial-scale metallurgical and chemical processes.

SUMMARY OF THE INVENTION

It is the object of the present invention to avoid the disadvantages mentioned above and to provide a jet compressor of the aforementioned type which is simple in design and as compact as possible and to achieve improved efficiency and pressure ratios in comparison to jet devices of the same scale while operating in a reliable manner.

Pursuant to this object, the driving nozzle of the jet compressor includes pursuant to the present invention a ring jet nozzle having a conical central body which narrows in diameter conically toward the mixing chamber. The compressible driving medium emerging from the nozzle in a ring-shaped manner has a high speed at the rim due to the short distance traversed within the nozzle, which leads to high speed gradients in the subsequent mixing and accordingly to an effective exchange of momentum in the turbulent shear layer between the driving steam and the moving medium.

In the ring-slot or annular-gap nozzle according to the invention, the driving medium does not exit exclusively as a free jet, but rather is guided as a ring through a central body in the shape of a tulip or bell. Since the bell extends only a short distance axially, the driving medium quickly comes into contact with the gas to be conveyed at the sharp orifice of the bell. This results in a speed profile whose maximum is not only higher due to the absence of the friction losses of the conventional Laval nozzle which has been dispensed with, but also has a discernibly smaller follow-up depression due to the annular nozzle construction of the central body. An intensive mixing of the driving medium and moving medium is achieved. As a result, the mixing chamber can have a distinctly shorter construction.

This advantage is compounded by a manufacture of the jet compressor which is simpler with respect to construction and less expensive in terms of manufacturing technology. Instead of a complicated manufacture precisely with respect to the conical construction of the conventional (Laval) nozzle, the sum of problems entailed in manufacture is concentrated on exactly fitting the diameter of the bell and the central body. In an economical manner, this high precision is not required for the entire shape of the central body itself.

In order to achieve a particularly intensive mixing of the media flows it is proposed that the contour of the central body be concave. In so doing, the contour is determined by way of optimization of a centered expansion fan which causes the driving medium to flow out in a virtually parallel manner after exiting the annular gap. This design leads to a construction of the orifice having a bottleneck facing the central body. This prevents the occurrence of compression shocks and the ensuing losses.

BRIEF DESCRIPTION OF THE DRAWINGS

An example of the invention is shown in the drawing.

DETAILED DESCRIPTION OF THE PREFERRED EMBODIMENTS

Figure 1:
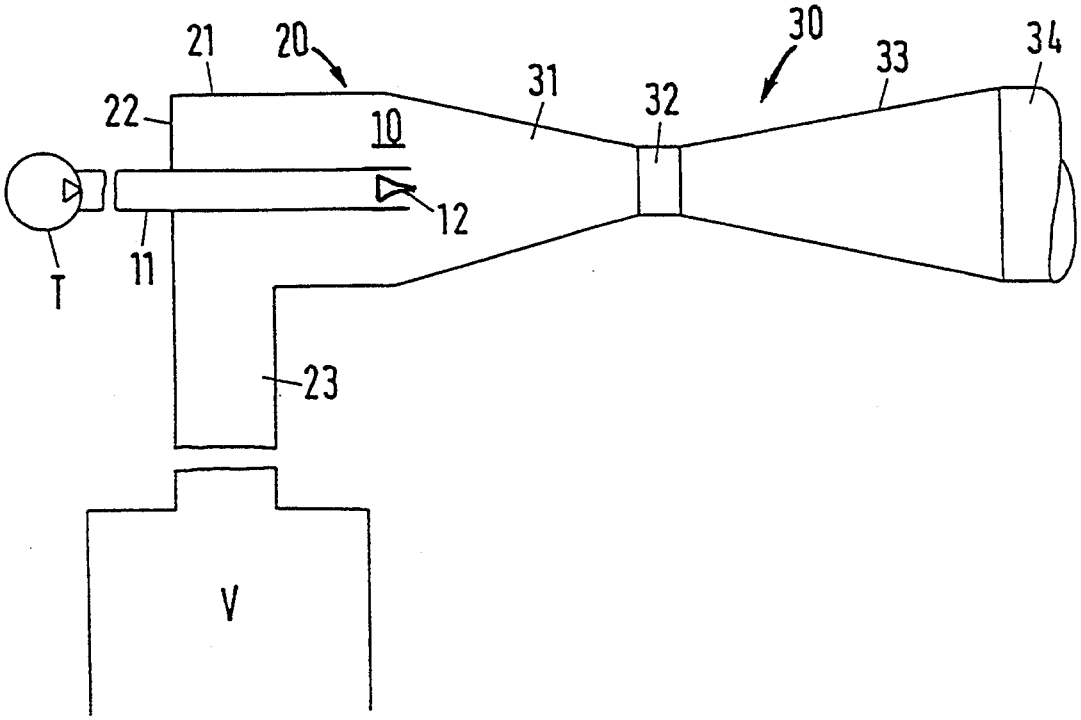
FIG. 1 shows a construction of the jet compressor.

The schematic drawing in FIG. 1 shows a vacuum station V which is connected with the jet head 20 via a vacuum suction line 23. A carrying-medium feed line 11 of a driving nozzle 10 which is connected by one end to a driving-medium feed station T projects into the jet head.

A nozzle 30 having a mixing chamber 31, an intermediate nozzle 32, and a pressure nozzle 33 connected with a pressure line 34 is connected to the jet head 20 which has a jet base 22 and a jet wall 21.

The orifice of the driving nozzle 10 is constructed as a ring jet nozzle. This ring jet nozzle has a conical central body 12 which narrows in diameter conically toward the mixing chamber 31 of the nozzle 30.

Figure 2:
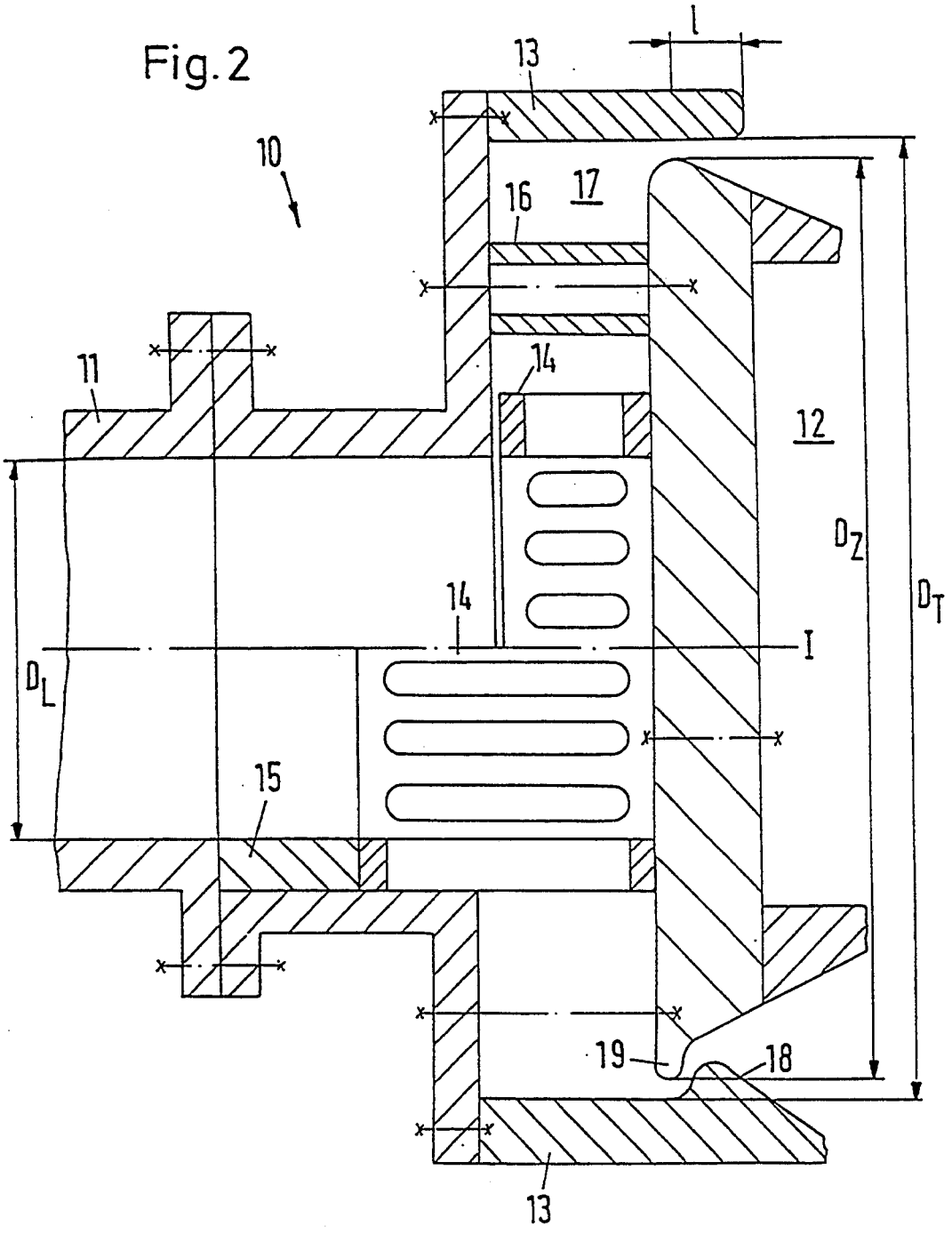
FIG. 2 shows a section of the annular-gap nozzle.

FIG. 2 shows the driving nozzle 10 with the driving-medium feed line 11 and the central body 12 provided in the orifice. The central body 12 is enclosed by an annular portion in the shape of a bell which axially adjoins the driving-medium feed line 11. A narrower annular gap is provided between the bell 13 and the bottom end of the central body 12. The bell 13 can be connected to the driving-medium feed line 11 and has an increased diameter on the orifice side, a rest chamber 17 being formed between the wall of the bell 13 extending in the radial direction and the bottom end of the central body 12. The axial dimensioning of the rest chamber 17 is determined by spacing sleeves 16 or a spacing tube 15. The central body 12 is fastened to the bell 13 by tension screws. A louver 14 is provided at the base of the central body 12 and has a diameter such that it projects into the rest space 17 (top part of drawing) or can be inserted into the more confined portion of the bell 13 (bottom part of drawing). The inner diameter of the latter bell shape corresponds to the diameter of the line tube of the driving-medium feed $D_L$.

The orifice of the bell 13 with the inner diameter $D_T$, which is 1.005 to 1.05 times greater than the outer diameter $D_Z$ of the central body 12, projects over the bottom end of the central body 12 in the outlet region by a length 1 that corresponds to 0.1 and 0.2 times the inner diameter $D_T$.

In a particular construction, the bottom region of the cone of the central body 12 has a disk-shaped widening 19. The orifice of the bell 13 which is inclined in relation to the principle axis I engages around this widening 19 in such a way that an annular gap is formed which is directed radially inward. The angle of taper or cone angle is greater in this region than in the rest of the central body 12. Furthermore, the bell 13 has an increase in diameter of $D_T/D_L=2/1-5/1$ facing the mixing chamber in comparison to the driving-medium feed line 11. The flow front of the rest chamber 17 has a surface area that is equal to or greater than the surface area of the flow front in the driving-medium feed line 11

.

I claim:

1. A jet compressor for steam for use in metallurgical or chemical processes, having a driving nozzle constructed as a ring jet nozzle, arranged centrically in a jet head and has a conical central body which narrows in diameter conically toward a mixing chamber, a pressure nozzle being connected coaxially to the latter, vacuum inducing means being connected to the jet head to facilitate jet degassing, wherein the central body has a cone with a concave shape in relation to an annular housing, the central body is enclosed in a region of a base of the cone by the annular housing so that a predominant portion of the conical central body projects out of an orifice of the housing, the orifice of the housing having a protrusion directed toward a principal axis of the housing and corresponding to a contour of the base region of the cone of the central body.

2. Jet compressor according to claim 1, wherein the housing has an inner diameter that is 1.005 to 1.05 times greater than an outer diameter of the central body.

3. Jet compressor according to claim 1, wherein the annular housing has a diameter and a length in a region of the orifice of the housing, the length corresponding to 0.1 to 0.2 times the housing diameter.

4. Jet compressor according to claim 3, characterized in that the orifice of the bell (13) has a bottleneck (18) facing the principle axis (I) and corresponding to the contour of the base region of the cone of the central body (12).

5. Jet compressor according to claim 1, wherein the base region of the cone of the central body (12) has a disk-shaped widening that engages upstream of the protrusion of the housing at a distance from the housing.

6. Jet compressor according to claim 1, and further comprising a driving medium feed line connected to an end of the housing opposite the central body cone, the housing increasing in diameter with a ratio of 2/1–5/1 toward the mixing chamber in comparison to the driving-medium feed line diameter.

7. Jet compressor according to claim 6, and further comprising a louver provided at the base of the central body, one end of the louver being insertable into the driving-medium feed line.

8. Jet compressor according to claim 6, wherein the base of the central body and a wall of the housing that extends in a radial direction form a rest chamber having a flow front with a surface area that is at least equal to a surface area of a flow front in the driving-medium feed line.

9. Jet compressor according to claim 6, wherein in the spacing means is a sleeve which is arranged between the base of the central body and a structural component part of the housing extending in a radial direction.

10. Jet compressor according to claim 6, wherein the central body is detachably fastened to one of the housing and the driving-medium feed line in an axial direction, and further comprising spacing means for fixing the central body in place.

11. Jet compressor according to claim 6, and further comprising a louver provided at the base of the central body and arranged in the region of a widening portion of the housing.

* * * * *